United States Patent [19]

Grover

[11] 4,365,614

[45] Dec. 28, 1982

[54] FRICTION SPACE HEATER

[76] Inventor: Robert R. Grover, R.F.D. #1, Winchester, N.H. 03470

[21] Appl. No.: 135,276

[22] Filed: Mar. 31, 1980

[51] Int. Cl.[3] ..... F24C 09/00

[52] U.S. Cl. ..... 126/247; 122/26

[58] Field of Search ..... 126/247; 122/26

[56] References Cited

U.S. PATENT DOCUMENTS 4,143,639 3/1979 Frenette ..... 126/247

*Primary Examiner*—Albert W. Davis
*Assistant Examiner*—John Huang
*Attorney, Agent, or Firm*—Diller, Ramik & Wight

[57] ABSTRACT

A space heater is operable at a low cost by a small electric motor which rotates an elongated tubular cylinder rotor member on a vertical axis, within an elongated cylindrical outer stationary member, and outwardly of an upper convection chamber member and a lower metering chamber member at a clearance of about five thirty-second of an inch in the vertical, outer and inner angular chambers formed therebetween. A supply of heavy lubricant normally occupies the lower portion of the vertical, outer and inner annular chambers and the lower metering chamber member but rises to fill the vertical, outer annular chamber and overflow the elongated tubular cylinder rotor member and return through the vertical, inner annular chambers to the lower portion during rotation of the elongated tubular cylinder rotor member; and serving for through flow of the lubricant. The elongated cylindrical outer stationary member is enclosed within a housing, having an upper plenum chamber with louver openings and a lower chamber containing an electric drive motor an an outwardly mounted electric motor and blower.

6 Claims, 5 Drawing Figures

FRICTION SPACE HEATER

BACKGROUND OF THE INVENTION

In U.S. Pat. No. 4,143,639 to Frenette of Mar. 13, 1979 an elongated sealed casing, or inner drum is rotated on a vertical axis within an elongated sealed cylindrical casing, or outer drum at a clearance of about one eighth of an inch in the annular chamber formed within. A light lubricating oil normally occupies the lower portion of the annular chamber but rises to fill the chamber during rotation of the inner drum to frictionally heat the lubricant within the device.

The previously known patent has several important drawbacks which make it unsuitable for continuous operation of the device with the lubricating oil at high temperature.

This prior patent has no means for temporarily cooling the heated lubricating oil to a lower temperature within the device, but with continuous operation prolongs the period of time during which the lubricating oil is kept at the high temperature generated in the device, because the lubricating oil occupies the annular space within the outer drum and rotating inner drum and since the temperature of the lubricating oil is highest in this particular part of the device, a prolonged duration of time in this annular space for the lubricating oil causes oxidation and temperature breakdown to the lubricating oil.

Also in the previously known patent the lubricating oil used is a low viscosity oil (40 to 45 SSU at 210 degrees F.) such that; with continuous operation at high temperature (210 degrees F. to 260 degrees F.) as in a friction heater, oxidation and temperature breakdown of the lubricating oil will occur in a short period of time.

SUMMARY OF THE INVENTION

Unlike the above mentioned patent wherein an elongated, cylindrical, inner drum comprises the rotor, in this invention an elongated tubular cylinder is the rotor. The tubular cylinder has a spoked driving disc attached an intermediate distance within to divide the tubular cylinder into a top recessed portion and a bottom recessed portion. The tubular cylinder is rotated in a horizontal plane on a vertical axis outwardly of an inner, extending, convection chamber member occupying the top recessed portion, and outwardly of an inner, extending, metering chamber member having an annular metering chamber with metering apertures, occupying the bottom recessed portion, and within an elongated, cylinder, outer stationary member with a top rim portion and a bottom rim portion, with the top rim portion joined to the inner, extending, convection chamber member, and the bottom rim portion joined to the inner, extending, annular metering chamber member to form outer and inner annular, vertical, chambers therebetween having a clearance of about five-sixteenth of an inch, and forming an upper horizontal chamber and a lower horizontal chamber about the spoked driving disc with a clearance of about three-eighths of an inch in the upper horizontal chamber and a clearance of about one-half of an inch in the lower horizontal chamber.

It can be seen that the spoked driving disc on its horizontal axis divides the invention into an upper portion consisting of outer and inner annular, vertical, chambers and a convection chamber, and a lower portion consisting of outer and inner annular, vertical, chambers and an annular metering chamber. A supply of heavy mineral oil is captive in the lower portions outer and inner, vertical, annular chambers and the annular metering chamber and at rest occupies the bottom thereof to a predetermined height. However upon rotation of the spoked driving disc and attached tubular cylinder by an electric drive motor of predetermined horse power, the oil is moved from the inner annular, vertical, chamber and rises in the outer annular, vertical, chamber of the elongated cylindrical outer stationary member due to the pumping action of the tubular cylinder, such that; with continued rotation of the tubular cylinder and metering of a portion of the oil from the annular metering chamber through the metering apertures, at a predetermined rate the oil continues to rise and fill the outer annular, vertical, chamber of the elongated cylindrical outer stationary member and becomes heated by internal friction in a heat generating cycle, by contact of the opposing surfaces of the elongated outer stationary member and the tubular cylinder with the oil; providing a uniform lowering of the viscosity of the heated oil as it rises in the annular, vertical, chamber, thereby; maintaining a constant rotational torque required to rotate the tubular cylinder contacting the oil as it rises to fill the outer annular, vertical, chamber and prevent exceeding the torque capacity of the electric drive motor, such that; with continued rotation of the tubular cylinder and continued metering of the remainder of the oil from the annular metering chamber through the metering apertures, the heated oil in the outer annular, vertical, chamber of the elongated cylindrical outer stationary member is forced to overflow in the upper portion of this invention, and flow axially and inwardly of the tubular cylinder, whereby; due to vortex flow and gravitional forces the oil in a short period of time is returned through the upper and lower inner annular, vertical, chambers to the lower portion of this invention in a regenerative cooling cycle prior to being centrifugally again moved to the outer, vertical, annular chamber of the elongated cylindrical outer stationary member to perform a further heat generating cycle, and thus; provide a continuous cyclic flowing of oil in a first heat generating cycle and a second regenerative cycle to continuously transfer heat to the elongated cylindrical outer stationary member, and supplementary heat to the convection chamber member.

A space heater is formed by enclosing the elongated cylindrical outer stationary member, the convection chamber member, the annular metering chamber member and the electric drive motor mid-way of a housing, with an upper plenum chamber with louver openings and a lower air chamber. An air blower and separate electric motor is mounted outwardly of the lower air chamber to blow ambient air inwardly and upwardly around the electric drive motor and the heated outer surface of the elongated cylindrical outer stationary member and within the heated outer surface of the convection chamber member in a continuous flow path for discharge of the heated air through the louver opening of the plenum chamber back into the ambient atmosphere.

DESCRIPTION OF A PREFERRED EMBODIMENT

Figure 1:
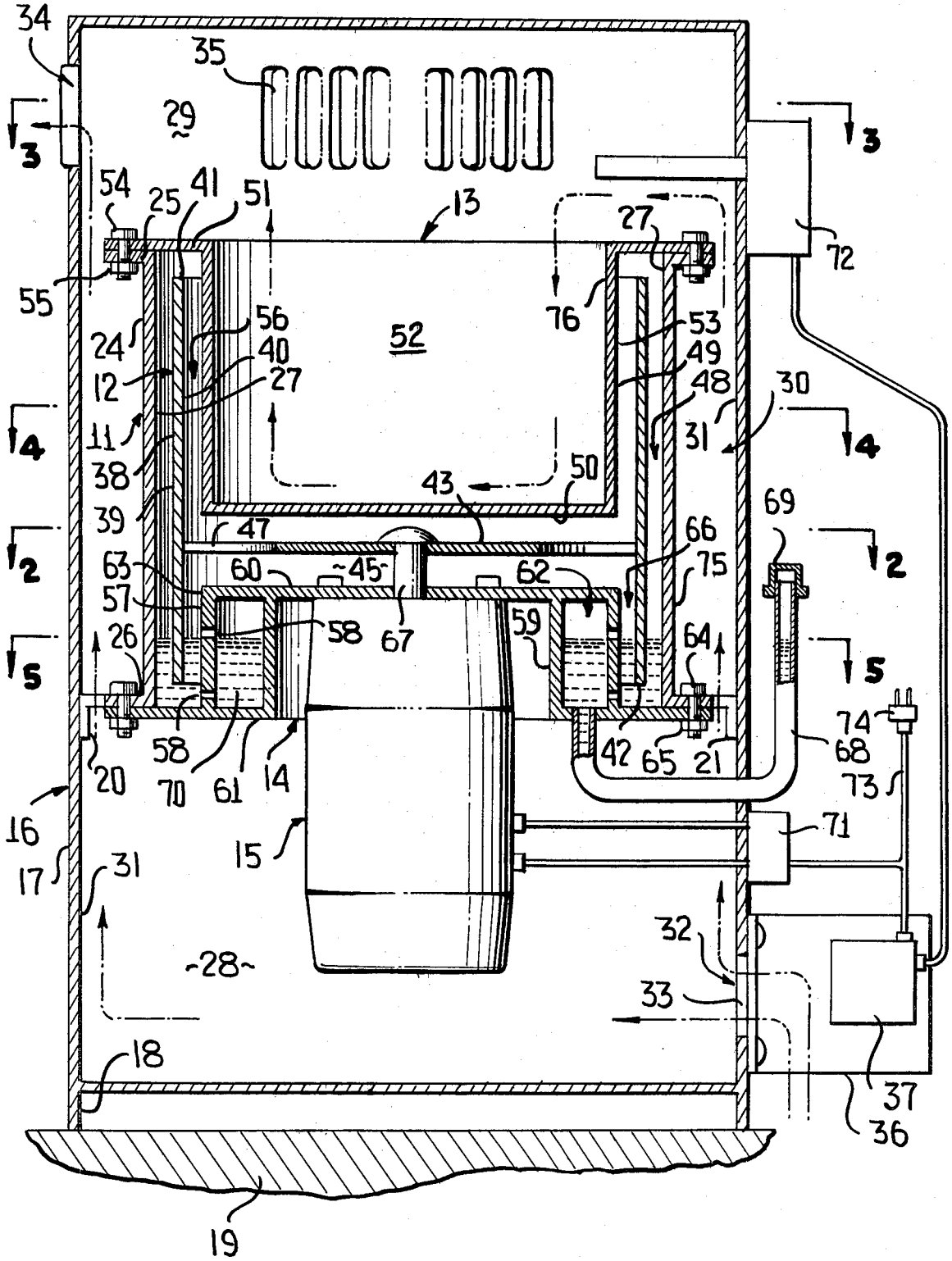
FIG. 1 is a front elevational view of the friction space heater of the invention in its preferred form, in half section.

FIGS. 1, 2, 3, 4 and 5 illustrates the embodiment of the friction space heater 10 comprising, an outer stationary member 11, a tubular cylinder rotor member 12 a convection chamber member 13, a metering chamber member 14 and an electric drive motor 15 of the invention which includes an upstanding hollow, cylindrical, housing 16 formed of sheet metal 17 and having legs 18 for supporting it on a floor 19 of a building. The space heater 10 is portable and in the portable embodiment illustrated in FIGS. 1, 2, 3, 4 and 5 the housing 16 is of a predetermined diameter of about sixteen inches and a predetermined height of about thirty inches.

Fixed within housing 16 by suitable brackets 20, 21, 22 and 23 is the outer stationary member 11 formed by an aluminum casting or the like process, having an elongated cylindrical sidewall 24 with a top extending rim 25 and a bottom extending rim 26. The elongated cylindrical sidewall 24 having an internal cylindrical surface 27 of a predetermined diameter of about twelve and seven sixteen of an inch and a height of about ten inches, and the top extending rim 25 and bottom extending rim 26 which is of a predetermined outer diameter less than the diameter of the housing 16, such as about fourteen inches.

The outer stationary member 11 is located about mid-way of housing 16 and divides the housing 16 into the lower air chamber 28 and the upper plenum chamber 29, there being an annular air chamber 30 formed between the cylindrical side wall 24 of the outer stationary member 11 and the coaxial, concentric, cylindrical sidewall 31 of the housing 16.

Air inlet means 32 is provided in the lower air chamber 28 of the housing 16 in the form of an opening 33 in the cylindrical sidewall 31 and air outlet means 34 is provided in the upper plenum chamber 29 in the form of spaced louver openings 35. The annular air chamber 50 connects the air inlet means 32 to the air outlet means 34 of the upper plenum chamber 29.

An air blower 36 and electric motor 37 of about one eighth H. P. for driving the air blower 36, are mounted outwardly of the lower air chamber 28 enclosing the opening 33 in the cylindrical side wall 31 for driving ambient air upwardly in an annular flow path in chamber 30 from the air inlet means 32 to the air outlet means 34.

Figure 2:
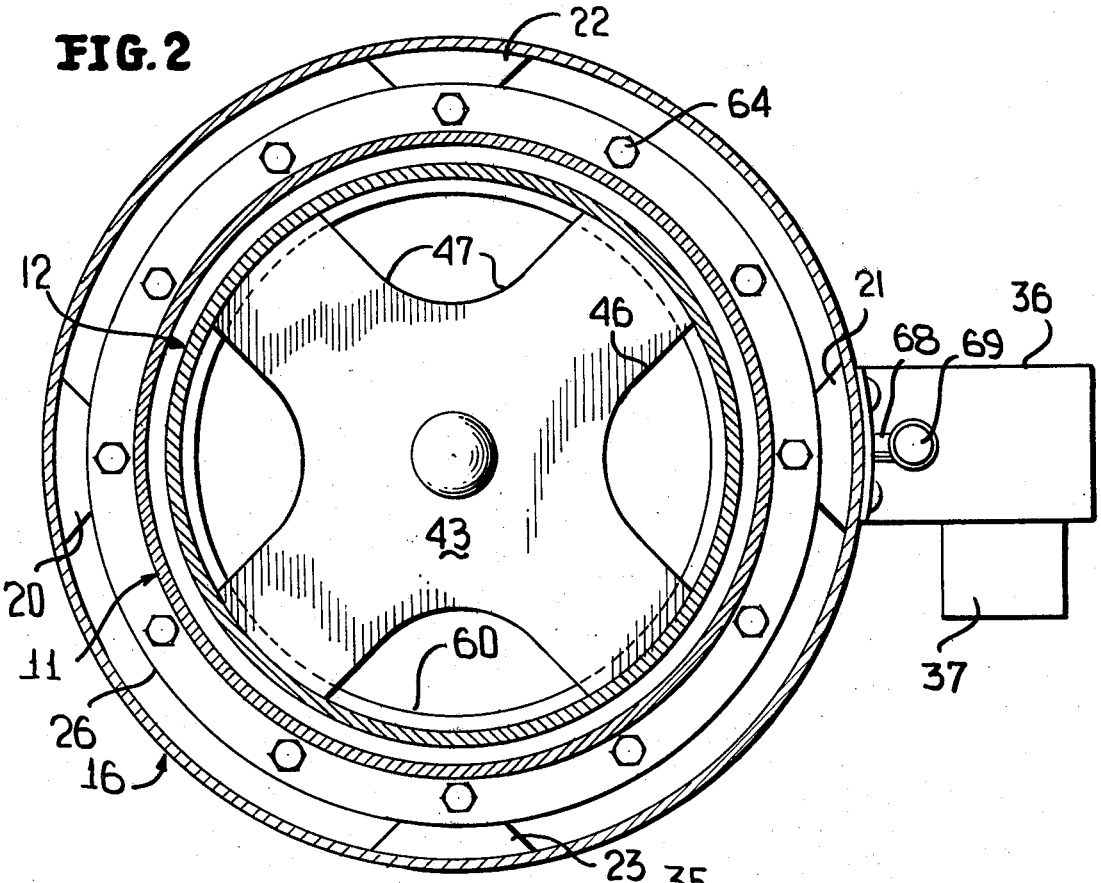
FIG. 2 is a sectional view taken along line 2—2 of FIG. 1.
Figure 3:
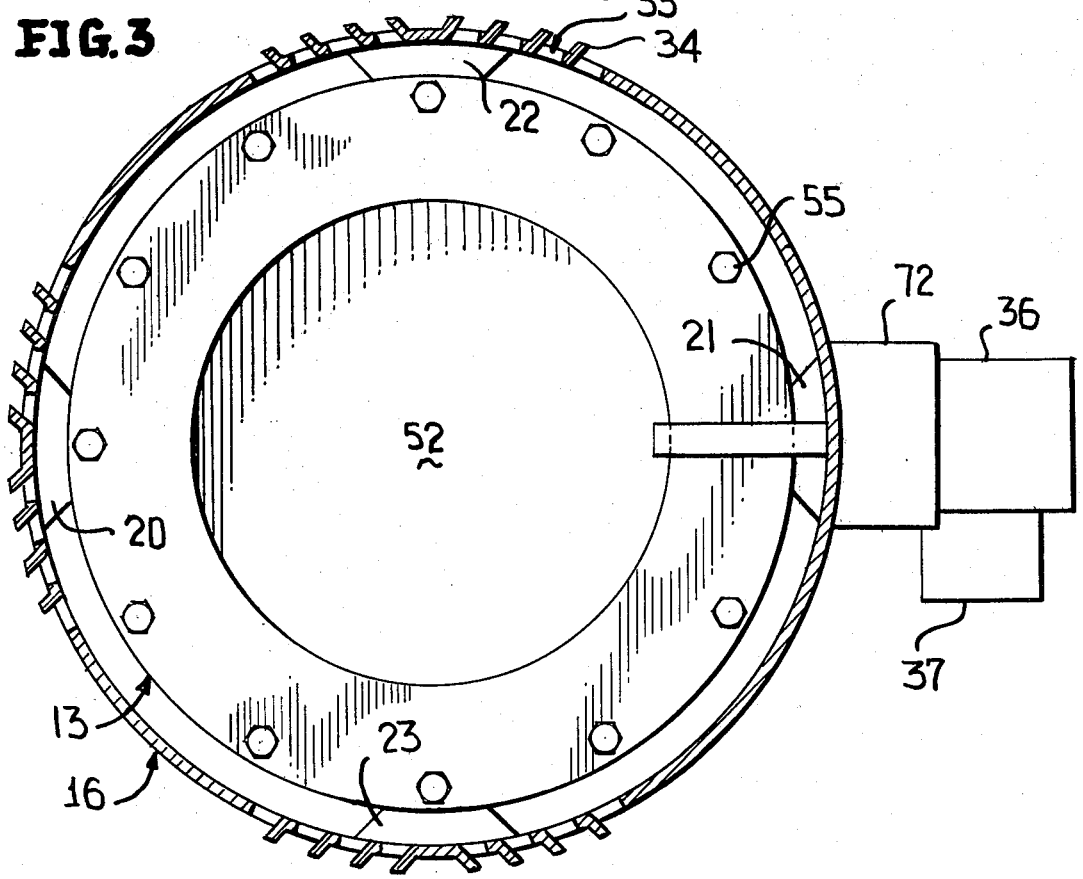
FIG. 3 is a sectional view taken along line 3—3 of FIG. 1.
Figure 4:
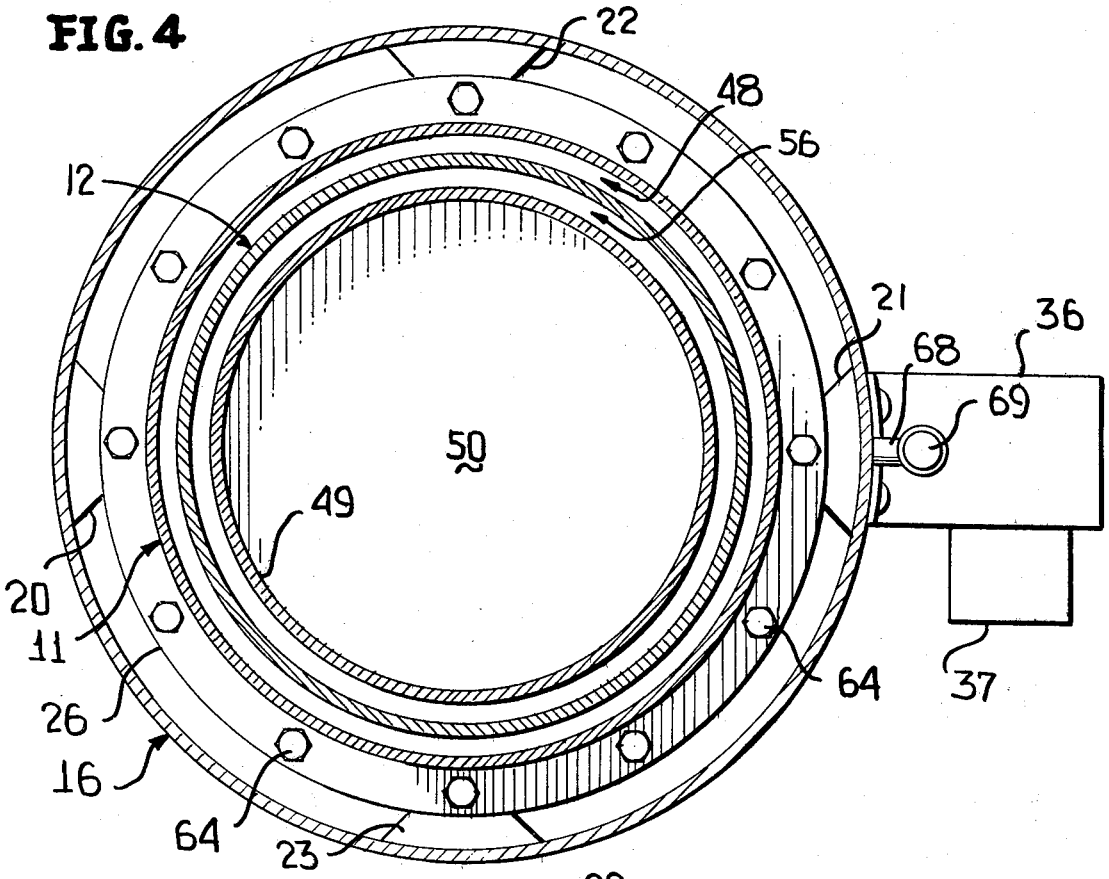
FIG. 4 is a sectional view taken along line 4—4 of FIG. 1.
Figure 5:
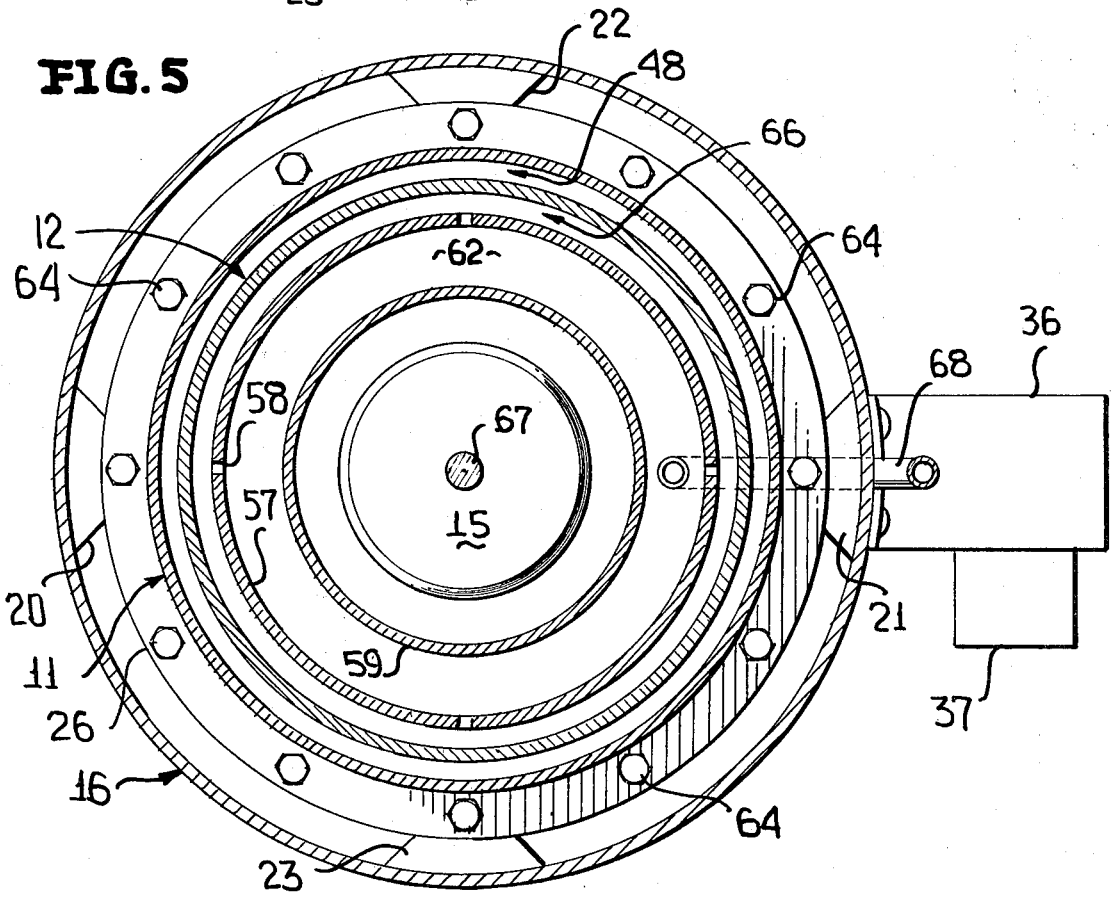
FIG. 5 is a sectional view taken along line 5—5 of FIG. 1.

Held within the outer stationary member 11 (as will be explained later) is the tubular cylinder rotor member 12 which is of a predetermined outer diameter of about twelve and one eighth inches and a height of about nine inches, being formed of stainless steel as an elongated, thin walled tubular cylinder 38 with an exterior cylindrical surface 39, an interior cylindrical surface 40, a top rim 41 and bottom rim 42. The tubular cylinder rotor member 12 includes a spoked driving disc 43 formed of sheet metal and is fixedly attached (by welding or like process) a predetermined distance within the tubular cylinder 38 to divide the tubular cylinder rotor member 12 into an upper recessed portion 44 and a lower recessed portion 45. The spoked driving disc 43 as viewed in FIG. 2 is provided with four equally spaced spokes 46 about the interior cylindrical surface 40 of the tubular cylinder 38 with the interspaces thereby formed to provide openings 47 between the upper recessed portion 44 and lower recessed portion 45. The exterior cylindrical surface 39 of the tubular cylinder 38 and the interior cylindrical surface 27 of the outer stationary member 11 are at about five thirty-second of an inch clearance from each other to form an annular chamber 48 therebetween.

The convection chamber member 13 is formed by an aluminum casting or like process, having an elongated cylindrical side wall 49 with a bottom diametrical wall 50 and a top extending rim 51, to form an inner convection chamber 52 therein. The elongated cylindrical side wall 49 having an exterior cylindrical surface 53 of about eleven and eleven-sixteen inches and a length of about six inches, and the top extending rim 51 having a predetermined diameter of about fourteen inches. The convection chamber member 13 is secured to the outer stationary member 11 by bolts 54 and locknuts 55 extending through the top extending rim 51 and top extending rim 25, with the elongated cylindrical side wall 49 and bottom diametrical wall 50 telescoping within the upper recessed portion 44 of the tubular cylinder rotor member 12, such that; the exterior cylindrical surface 53 of elongated cylindrical side wall 49 and the interior cylindrical surface 40 of the tubular cylinder 38 are at about five thirty-second of an inch clearance from each other to form an annular chamber 56 therebetween, and the bottom diametrical wall 50 and the spoked driving disc 43 are at a clearance of about three eighths of an inch, and the top extending rim 51 and the top rim 41 of the tubular cylinder 38 are at a clearance of about three quarter of an inch.

The metering chamber member 14 is formed by an aluminum casting or like process, having an elongated cylindrical outer side wall 57 with a predetermined number of metering apertures 58 of about three sixty-fourth of an inch diameter extending through, and an imperforate elongated inner side wall 59 and both joined to a top diametrical wall 60 and a bottom extending rim 61 with a clearance of about one inch in the horizontal annular metering chamber 62 formed therebetween. The elongated cylindrical outer side wall 57 having an exterior cylindrical surface 63 of a predetermined diameter of about eleven and eleven-sixteen inches and a length of about three inches, and the bottom extending rim 61 having a predetermined diameter of about fourteen inches. The metering chamber member 14 is secured to the outer stationary member 11 by bolts 64 and locknuts 65 extending through the bottom extending rim 26 and bottom extending rim 61 with the elongated cylindrical outer side wall 57 and top diametrical wall 60 to occupy the lower recessed portion 45 of the tubular cylinder rotor member 12, such that; the exterior cylindrical surface 63 of the elongated cylindrical outer side wall 57 and the interior cylindrical surface 40 of the tubular cylinder 38 are at about five thirty-second of an inch clearance from each other to form an annular chamber 66 therebetween, and the top diametrical wall 60 and the spoked driving disc 43 are at a clearance of about one half of an inch, and the bottom extending rim 61 and the bottom rim 42 of the tubular cylinder 38 are at a clearance of about one quarter of an inch.

An electric drive motor 15 is mounted to the metering chamber member 14 with the motor shaft 67 extending through the top diametrical wall 60 and is fast to the spoked driving disc 43 to rotate the tubular cylinder 38 which is supported by the motor shaft 67 and electric drive motor 15 anti-friction bearings (not shown). The electric drive motor 15 being of about one and one half H.P. for rotating the motor shaft 67 at about 1750 R.P.M.

It should be noted that the outer stationary member 11, the convection chamber member 13, the metering chamber member 14 and the electric drive motor 15 form a sealed enclosure about the tubular cylinder rotor member 12 except for the filler tube 68, which is joined to the horizontal annular metering chamber 62 of the metering chamber member 14, and is closed by a removable threaded cap 69.

As shown in FIG. 1, a supply of mineral oil 70 such as a quart of No. 90 oil is captive in the annular chamber 48 and the annular chamber 66 and the annular metering chamber 62, and at rest occupies the bottom thereof to a predetermined height.

It has been found that the best results are obtained when the lubricant oil 70 is "Amalie" Straight Mineral "GL" Gear Lubricant SAE No. 90, with a high viscosity, 100.6 SSU at 210 degrees Fahrenheit.

The electric drive motor 15 is connected to a thermostat 71, of any well known type and the electric motor 37 driving the air blower 36 is connected to a fan control 72 of any well known type by cord 73 and to a source of electricity by male plug 74, such that; the electric drive motor 15 is energized under control of ambient temperature by the signals of the thermostat 71 until a predetermined temperature is reached in the plenum chamber 29, whereupon the fan control 72 automatically energizes the electric motor 36 driving the air blower 37 to furnish hot air to a room.

In operation the electric drive motor 15 drives the tubular cylinder rotor member 12 at a substantial speed, which causes the oil 70 to rise up into the annular chamber 48 adjacent the outer stationary member 11 due to the pumping action of the tubular cylinder 38, such that; with continued rotation of the tubular cylinder rotor member 12 and metering of a portion of the oil 70 from the annular metering chamber 62 at a predetermined rate the oil 70 continues to rise and fill the annular chamber 48 and becomes heated by internal friction in a heat generating cycle, by contact of the surface 27 of the outer stationary member 11 and cylindrical surface 39 of tubular cylinder 38 with the oil 70, providing a uniform lowering of the viscosity of the heated oil 70 as it rises in the annular chamber 48, thereby; maintaining a constant rotating torque required to rotate the tubular cylinder 38 contacting the oil 70 as it rises to fill the annular chamber 48 and prevent exceeding the torque capacity of the electric drive motor 15, such that; with continued rotation of the tubular cylinder rotor member 12 and continued metering of the remainder of the oil 70 from the annular metering chamber 62 the heated oil 70 in the annular chamber 48 is forced to overflow to the upper recessed portion 44 of the tubular cylinder rotor member 12 and flow axially and inwardly of the tubular cylinder 38, whereby; due to vortex flow and gravitational forces the oil 70 in a short period of time is returned through the annular chamber 56 and the openings 47 of the spoked driving disc 43 to the annular chamber 66 in the lower recessed portion 46 of the tubular cylinder rotor member 12 in a regenerative cooling cycle, prior to again being moved to the annular chamber 48 to perform a further heat generating cycle, as before explained.

Accordingly, with continuous rotation of the tubular cylinder rotor member 12 provides a continuous cyclic flowing of oil 70 in a first heat generating cycle to transfer heat to the outer stationary member 11, and a second regenerative cycle to transfer supplementary heat to the convection chamber member 13 so that the exterior surface 75 of the outer stationary member 11 and the interior surface 76 of the convection chamber member 13 until a predetermined temperature is reached in the upper plenum chamber 29, whereupon; the fan control 72 automatically energizes the electric motor 37 driving the air blower 36 to blow ambient air through the air inlet means 32 inwardly and upwardly around the heated exterior surface 75 of the outer stationary member 11 and within the heated exterior surface 76 of the convection chamber member 13 in a continuous flow path for discharge of the heated air through the air outlet means 34 back into the room.

From the foregoing, it will be seen that novel and advantageous provisions have been made for carrying out the desired end. However, attention is again directed to the fact that additional variations may be made in this invention without departing from the spirit and scope thereof as defined in the appended claims.

I claim:

1. An odorless, combustion-less quiet heater comprising;

an elongated tubular cylinder with a spoked driving disc attached an intermediate distance within to divide the tubular cylinder into a top recessed portion and a bottom recessed portion;

said tubular cylinder to rotate in a horizontal plane on a vertical axis outwardly of an inner extending convection chamber member having a convection chamber to occupy the said top recessed portion, and outwardly of an inner extending metering chamber member having an annular metering chamber with metering apertures to occupy the said bottom recessed portion, and within an elongated, cylindrical, outer stationary member with a top rim portion and a bottom rim portion, with the said top rim portion joined to the said convection chamber member, and the said bottom rim portion joined to the said metering chamber member to form outer and inner annular vertical chambers therebetween, having a clearance of about five-sixteenth of an inch, and forming an upper horizontal chamber and a lowr horizontal chamber about the said spoked driving disc with a clearance of about three-eighth of an inch in the said upper horizontal chamber and a clearance of about one-half of an inch in the said lower horizontal chamber;

said driving disc on its horizontal axis divides the said heater into an upper portion consisting of said outer and inner annular, vertical, chambers and said convection chamber and a lower portion consisting of said outer and inner annular, vertical chambers and said annular metering chamber;

a supply of oil normally occupying only said lower portions said outer and inner annular, vertical chambers and said annular metering chamber to a predetermined height but adapted to be raised upwardly into the said outer annular, vertical, chamber in a heat generating cycle, and with metering of the said oil from the said annular metering chamber through the said metering apertures cause the heated said oil to overflow in the said upper portion of the said heater, whereby; due to vertex flow and gravitional forces the heated said oil is returned through the said upper portion's said inner annular, vertical, chamber and through the said spoked driving disc to the said lower portion's said inner annular, vertical, chamber in a regenerative cooling cycle, when the said tubular cylinder is rotated on said vertical axis at substantial speed;

and electric motor means for rotating said spoked driving disc and said tubular cylinder on said vertical axis outwardly of said convection chamber mamber and outwardly of said metering chamber member and within said outer stationary member to heat said oil and transfer said heat to the outer surface of said outer stationary member and supplementary heat to the outer surface of said convection chamber member.

2. A heater as specified in claim 1 wherein:

said oil is a heavy oil and is normally occupying only said lower portion of said heater to a predetermined height;

and said heavy oil is in contact with said tubular cylinder within said outer and inner annular, vertical, chambers to a predetermined height.

3. A heater as specified in claim 1 wherein:

said oil is metered from the said annular metering chamberthrough the said metering apertures at a predetermined rate as the said oil rises to fill the said outer annular, vertical chamber and becomes heated in the said heat generating cycle, thereby; providing a uniform lowering of the viscosity of said oil at a predetermined rate;

and the said metering of said oil at a predetermined rate providing means for maintaining a constant rotational torque required to rotate the said tubular cylinder contacting the said oil as the said oil rises to fill the said outer annular, vertical, chamber and prevent exceeding the torque capacity of the said electric motor means.

4. A heater as specified in claim 1 wherein:

said outer stationary member joined to said convection chamber member and said metering chamber member and said electric motor means form a sealed enclosure for the said tubular cylinder and said spoked driving disc except for an oil conduit connected to said annular metering chamber, with said conduit being closed by means of a threaded cap.

5. A heater as specified in claim 1 plus:

housing means extending around said outer stationary member, said convection chamber member, said metering chamber member and said electric motor means, including an air inlet and an air outlet and;

electric motor operated blower means outwardly of said housing for blowing ambient air into said housing, around said outer stationary member and within said convection chamber member and discharging it out of said housing.

6. The method of generating heat in an odorless, flameless, noiseless manner by means of an outer, stationary, member, a convection chamber member and a metering chamber member, with a tubular cylinder rotor member, rotably mounted outwardly of said convection chamber member and said metering chamber member, and within said outter stationary member, there being a supply of oil continously recirculating within said outer, stationary, member and outwardly of said convection chamber member and said metering chamber member, said method comprising the steps of forming said outer, stationary, member as an elongated, cylindrical, side wall portion with a top extending rim portion and a bottom extending rim portion forming said tubular cylinder rotor member as an elongated, tubular, cylinder with a spoked driving disc fixedly attached thereto an inermediate distance within to divide the said tubular, cylindrical, rotor member into an upper recessed portion and a lower recessed portion, and said tubular cylinder rotor member rotates on a central vertical axis relative to the said outer, stationary, member with a clearance of about five thirty-second of an inch in the outer annular vertical chamber formed therebetween forming said convection chamber member as an elongated side wall portion with a diametrical wall bottom portion and a top extending rim portion, with said top extending rim portion affixed to said top extending rim portion of said outer, stationary, member and said convection chamber member to occupy the upper recessed portion of said tubular cylinder rotor member with a clearance of about five thirty-second of an inch in the vertical annular chamber formed therebetween and said diametrical wall bottom portion is at a clearance of about three-eighth of an inch with afore said spoked driving disc forming said metering chamber member as an elongated, outer, side wall portion with a multiplicity of peripheral metering aperatures and a imperforate elongated inner side wall portion and both joined to a diametrical wall top portion and a bottom extending rim portion, with a clearance of about one inch in the annular metering chamber formed therebetween, with said bottom extending rim portion affixed to said bottom extending rim portion of said outer, stationary, member and said metering chamber member telescoping within said lower recessed portion of said tubular cylinder rotor member with a clearance of about five thirty-second of an inch in the vertical annular chamber formed therebetween and said diametrical wall top portion is at a clearance of about one half inch with aforesaid spoked driving disc limiting the supply of oil within said outer, stationary, member and said metering chamber member and said annular metering chamber to a predetermined quantity so that it normally occupies only the bottom of the same to a predetermined height and then rotating the said tubular cylinder rotor member at substantial speed within said outer, stationary member to heat said oil, and firstly centrifugally cause it to rise up into the aforesaid outer annular vertical chamber and transfer heat to said outer, stationary, member in a heat generating cycle, and secondly, with metering of said oil in said annular metering chamber cause the heated oil to overflow the top rim of said tubular cylinder rotor member and flow axially and inwardly of said tubular cylinder rotor member due to vortex flow, in a regenerative cooling cycle prior to being centrifugally again moved to the aforesaid outer annular, vertical, chamber to perform a further heat generating cycle, and thereby providing for continuous cyclic flowing of said oil in a first heat generating cycle and a second regenerative cycle to continuously transfer heat to said outer, stationary, member and supplementary heat to said convection chamber member.

* * * * *